US005211474A

United States Patent [19]

Leitner et al.

[11] Patent Number: 5,211,474

[45] Date of Patent: May 18, 1993

[54] DO-IT-YOURSELF LAMP SHADE KIT

[75] Inventors: Keith R. Leitner; Laurie M. Leitner, both of Eau Claire, Wis.

[73] Assignee: Wisconsin Lighting, Inc., Eau Claire, Wis.

[21] Appl. No.: 755,504

[22] Filed: Aug. 30, 1991

[51] Int. Cl.[5] ..... F21V 1/12; F21V 1/14

[52] U.S. Cl. ..... 362/351; 362/356; 362/357

[58] Field of Search ..... 362/351, 356, 357, 355, 362/358, 457, 458, 806

[56] References Cited

U.S. PATENT DOCUMENTS

| | | | |
|---|---|---|---|
| 1,537,777 | 5/1925 | Liedtke | 362/351 |
| 1,580,922 | 4/1926 | Scherer | 362/351 |
| 1,583,568 | 5/1926 | Berkowitz | 362/351 |
| 2,813,053 | 11/1957 | Tuomala | 362/351 |
| 4,068,120 | 1/1978 | Throckmorton et al. | 362/351 |
| 4,731,715 | 3/1988 | Anderson | 362/357 |

FOREIGN PATENT DOCUMENTS

| | | | |
|---|---|---|---|
| 2151010 | 7/1985 | United Kingdom | 362/357 |

OTHER PUBLICATIONS

M. Rourke, "Lampshades Simple and Advanced", 1967 pp. 1-15.

A. Fishburn, "Making Lampshades", 1975, pp. 7 and 82-83.

*Primary Examiner*—Richard R. Cole

*Attorney, Agent, or Firm*—Merchant, Gould, Smith, Edell, Welter & Schmidt

[57] ABSTRACT

A do-it-yourself lamp shade kit is disclosed. The kit includes a lamp shade base and pattern sized to approximate a size and shape of a fabric to cover the base. In addition to acting as a pattern for cutting out a fabric, the stiff paper of the pattern provides protection to the styrene base during shipping. Namely, the paper is selected to have a thickness which can withstand, at least partially, impact during handling and shipping.

9 Claims, 2 Drawing Sheets

DO-IT-YOURSELF LAMP SHADE KIT

I. BACKGROUND OF THE INVENTION

1. Field of the Invention

This invention pertains to a do-it-yourself lamp shade kit. More particularly, this invention pertains to such a lamp shade kit having a pattern to approximate a size and shape of a fabric to cover a lamp shade base.

2. Description of the Prior Art

Common lamp shades are generally frusto-conical in shape. They are provided by manufacturers with a variety of fabrics and other coverings which are decorative. From time to time, it is desirable to provide a decorative covering for a lamp shade which is unique to a homeowner's decor. For example, a homeowner may wish to have a lamp shade with fabrics selected to match or complement upholstery, window treatments, wall coverings and the like.

Decorator lamp shades which are selected to match a decor are expensive. Accordingly, many homeowners must suffer an inappropriately selected material rather than incur the expense of a decorator lamp shade.

In times of rising costs, homeowners are increasingly turning to do-it-yourself projects for both cost savings and personal satisfaction. It is an object of the present invention to provide a do-it-yourself lamp shade kit to permit individuals to enjoy the benefits of decorator lamp shades without the associated costs.

II. SUMMARY OF THE INVENTION

According to a preferred embodiment of the present invention, a do-it-yourself lamp shade kit is provided. The lamp shade kit includes a lamp shade base and a pattern sized to approximate a size and shape of a fabric needed to cover the base.

III. BRIEF DESCRIPTION OF THE DRAWINGS

IV. DESCRIPTION OF THE PREFERRED EMBODIMENT

Figure 2:
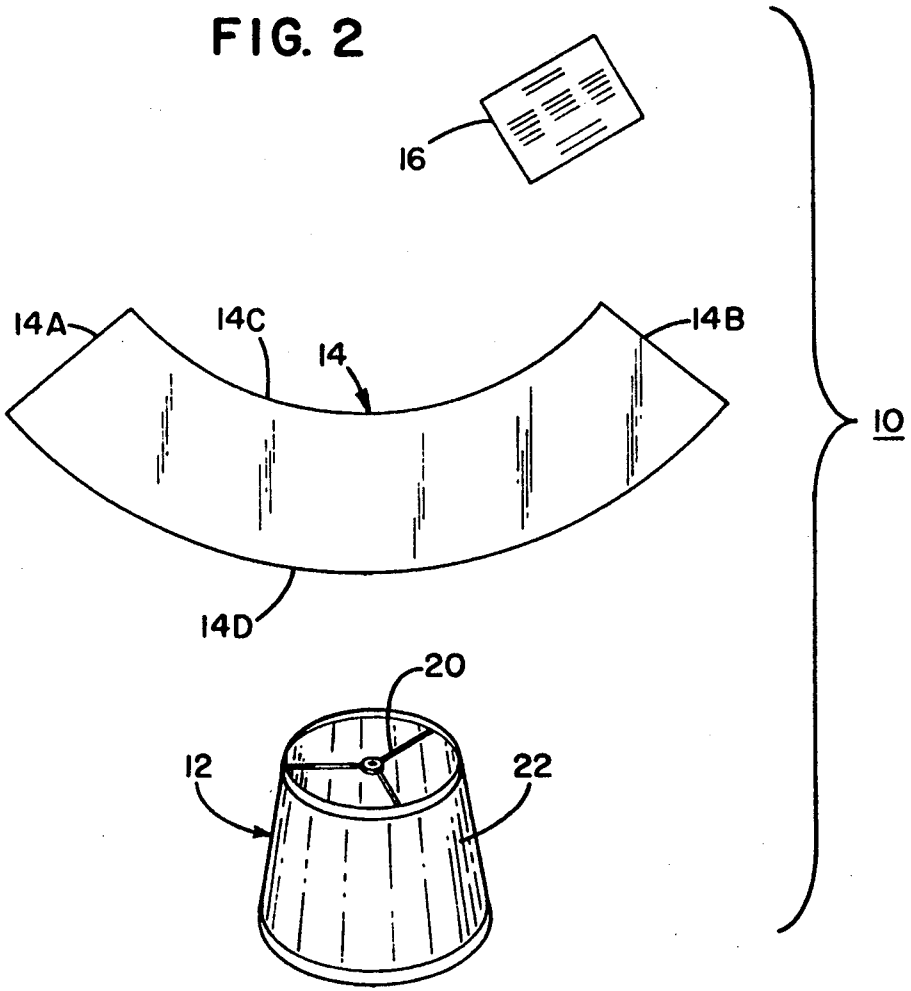
FIG. 2 is an exploded view of the lamp shade kit of FIG. 1.

With reference now to the various drawing figures in which identical elements are numbered identically throughout, a description of the preferred embodiment of the present invention will now be provided. A lamp shade kit 10 includes a base 12, a pattern 14, instructions 16 and a transparent protective covering 18. The kit is shown assembled in FIG. 1. The kit is shown disassembled or exploded in FIG. 2 (without the protective covering 18 being shown in FIG. 2).

As shown in the Figures, the base 12 is the familiar frusto-conical shape. It includes a wire frame 20 surrounded by a frusto-conical shaped base material 22. In a preferred embodiment, the base material 22 is styrene which accepts and adheres to fabric adhesives. (It will be appreciated by those skilled in the art that fabric adhesives are commercially available and well known.)

Figure 1:
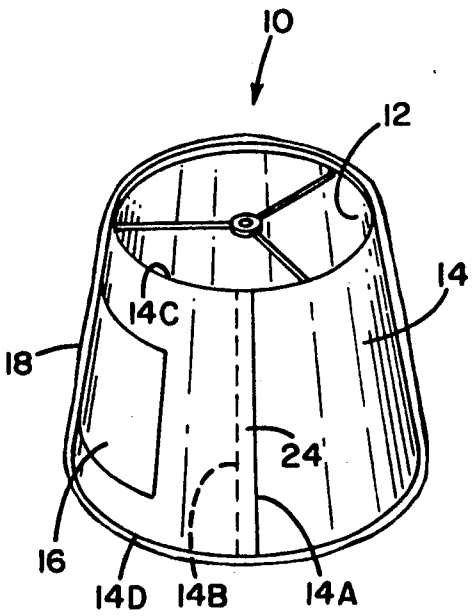
FIG. 1 is a perspective view of a lamp shade kit according to the present invention.
Figure 5:
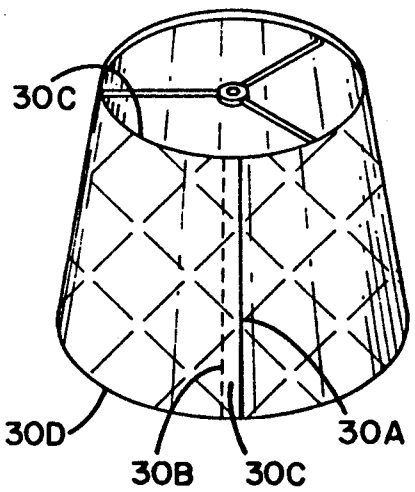
FIG. 5 is a perspective view of a completed lamp shade.

The pattern 14 when laid flat (as shown in FIG. 2) is a stiff paper (such as dulcote paper which is commonly used in the lamp shade industry in the shape of an arc of a ring. It is preferably dye cut to precision size and shaped such that is deformable around material 22 to achieve the frusto-conical shape of material 22 when placed on base 12 in overlying relation as shown in FIG. 1. The pattern 14 is dimensioned such that when placed on the base material 22, the pattern 14 assumes the frusto-conical shape of material 22 and side edges **14*a*,14*b* of the pattern 14 overlap one another to form an overlapping seam 24. In a preferred embodiment, seam 24 has a width of about 3/4 of an inch. Further, the material 14 has a height (i.e., the distance between edges 14*c*, 14*d*) equal to the height of the base 12**.

The pattern 14 is formed of a stiff paper which can be bent to the frusto-conical shape but which will lay flat to assume its arc shape as shown in FIG. 2. When surrounding the base 12, the pattern 14 is provided with adhesive tape 26 or the like to retain the pattern 14 in the frusto-conical shape.

Figure 4:
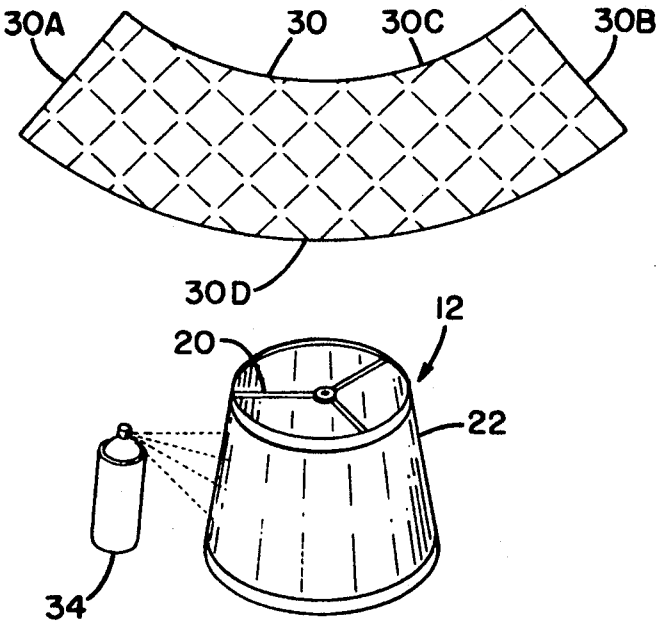
FIG. 4 is a view showing application of a fabric to the lamp shade.
Figure 3:
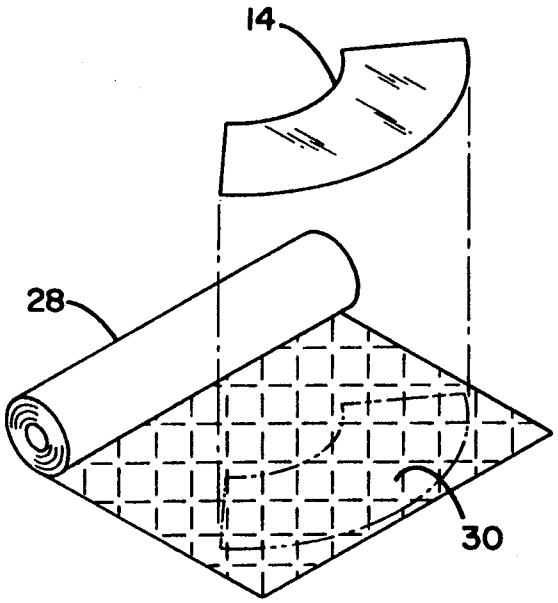
FIG. 3 is a view showing application of a pattern of the kit to a bolt of fabric.

When flat, the pattern 14 may be placed on a fabric 28 and used as a pattern to cut out a final fabric 30 of desired decorative material. When cut out from pattern 14, the fabric 30 is of the proper dimensions to be placed on the base 12 and cover the base 12 with an overlying seam 31. Accordingly, the pattern 14 can be used to cut a fabric from any desired design to permit a do-it-yourself homeowner to achieve a decorative fabric design of desired design on the lamp shade to make a completed lamp shade 32. To adhere the fabric 30 to the base 12, an adhesive (which are commercially available and well known in the art) is applied to the back surface of the fabric through any application means. In FIG. 4, the adhesive is shown as a spray adhesive 34. The adhesive adheres to both the fabric and the base material 22 to retain the fabric 30 on the base 12.

The kit includes instructions 16 which instruct the homeowner on how to trace the pattern onto the fabric and cut out the pattern. In a preferred embodiment, the instructions advise the homeowner to turn under the fabric edge **30*a* under and press a ¼ inch edge for a clean seam. The fabric glue 34 is sprayed or otherwise applied to the entire surface of the shade body material 22. Starting on the back seam of the shade body 21, the raw (i.e., unfolded) edge 30*d* is applied to the shade. The fabric is continued to be applied to the body 22 until the finished edge 30*a* covers the unfinished edge 30*d*. Any excess fabric on either the top or the bottom of the shade 32 is cut off. Any trim material (tape or ribbon, etc.) may be placed over the top or bottom edge 30*c*, 30*d* of the shade. The instructions may also include, if desired, means and instructions for pleating the fabric material 30 onto the shade 32. To pleat the shaded material 30**, three patterns are cut out of the fabric and stitched together. The fabric is gathered while following the lamp shade pattern. Machine paste along the top edge of the fabric is made to secure the pleats. The bottom edge is adjusted to fit the pattern.

From the foregoing detailed description of the present invention, it has been shown how the objects of the invention have been attained in the preferred manner. However, modifications and equivalents of the disclosed concepts such as readily occur to one skilled in the art are intended to be included within the scope of the present invention.

What is claimed is:

1. A do-it-yourself lamp shade kit comprising:

a lamp shade base, said base having a substantially continuous arcuate shape in cross-section and presenting a substantially solid outer surface surrounding said base; and a pattern sized to approximate a size and shape of a continuous length of a fabric with said size and shape selected for said fabric to cover said base with said fabric disposed to lie in face-to-face relation to said base and opposing and covering said outer surface;

said pattern comprising a sheet of material sized and shaped to cover said base when said pattern is disposed on said base in overlying relation, said material selected for said pattern to lie flat on a fabric when said pattern is removed from said base;

said kit including said pattern removably disposed on said base with said pattern opposing and said outer surface in overlying relation.

2. A lamp shade kit according to claim 1 wherein said pattern is disposed on said shade base covering said base.

3. A lamp shade kit according to claim 2 wherein said base is frusto-conical in shape.

4. A lamp shade kit according to claim 1 wherein said base includes a material surface sized to receive said fabric in overlying relation.

5. A lamp shade kit according to claim 4 wherein said material surface is susceptible to adhesion with a fabric adhesive.

6. A lamp shade kit according to claim 5 wherein said material surface is formed of styrene.

7. A lamp shade kit according to claim 1 wherein said kit includes instructions for using said pattern to form a fabric and apply said fabric to said base.

8. A lamp shade kit according to claim 1 wherein said sheet of material is a stiff material selected to at least partially withstand impact.

9. A lamp shade kit according to claim 8 wherein said sheet of material is a stiff paper.

* * * * *